United States Patent [19]

Kim

[11] 4,244,140

[45] Jan. 13, 1981

[54] TOYS WITH SHAPE MEMORY ALLOYS

[76] Inventor: Kibong Kim, 8415 Buckhannon Dr., Potomac, Md. 20854

[21] Appl. No.: 851,494

[22] Filed: Nov. 14, 1977

[51] Int. Cl.[3] ..... A63H 33/26; A63H 13/16; C22C 19/00; H01H 37/46

[52] U.S. Cl. ..... 46/145; 46/1 R; 46/162; 46/45; 75/170; 75/0.5 B; 337/393; 337/395

[58] Field of Search ..... 46/1 R, 161, 45, 226, 46/227–242, 248, 145, 162; 25/175.5, 170, 0.5 B; 337/393, 395

[56] References Cited

U.S. PATENT DOCUMENTS

| | | | |
|---|---|---|---|
| 3,091,053 | 5/1963 | Growald | 46/145 X |
| 3,450,372 | 6/1969 | Lange et al. | 75/170 |
| 3,832,243 | 8/1974 | Donkersloot et al. | 75/170 |
| 3,883,885 | 5/1975 | Orlando | 75/170 |
| 4,002,954 | 1/1977 | Orlando | 75/170 |
| 4,144,057 | 3/1979 | Melton et al. | 75/170 |

FOREIGN PATENT DOCUMENTS

| | | | |
|---|---|---|---|
| 2010841 | 3/1970 | Fed. Rep. of Germany | 75/0.5 B |

*Primary Examiner*—Gene Mancene
*Assistant Examiner*—Michael J. Foycik, Jr.

[57] ABSTRACT

Toys of any shape which recover their original shapes after deformation when they are heated by electrical or thermal stimulus are introduced. The deformation and shape recovery action can be repeated. The form regaining action is achieved by a special characteristics of the shape memory alloys, for example, nitinol, which change their phase and thereby change their shapes when their temperature is raised beyond their transition temperature. Toys are covered by a soft plastic to enhance the look of them.

3 Claims, 3 Drawing Figures

TOYS WITH SHAPE MEMORY ALLOYS

BACKGROUND OF THE INVENTION

Toys, ornamental shapes or any other geometrical figures which remember their original shapes are the object of this patent. Some form regaining toys go back to their original shape after an external stimulus which caused their original deformation has been removed. But they do so at some fixed rate which is not controllable by a user unless he applies an extra stimulus to the toy. Some other toys change their shape only when a user applies a stimulus upon it. But they only do so while they lose their structure integrity, preventing a possibility of repeated use of the toy without extensive corrective readjustments. This patent concerns with toys which regain their prefixed original shape only when a user applies a stimulus upon it, and at the same time, without losing its structural integrity so that the toys can be used repeatedly.

There is a host of alloys, called shape memory alloys. When an alloy of this group is annealed at a very high temperature (typically 1000° C. or above) in a given shape, the shape is fixed permanently unless it is annealed once again. If the alloy is cooled down below a certain temperature (typically 45° C.~80° C.), called a transition temperature, it becomes quite weak mechanically and can thus be deformed relatively easily. After the deformation, if the temperature of the alloy is raised above the transition temperature, it recovers its originally fixed shape by changing phase of its crystal structure. Both the annealing temperature and the transition temperature depend on alloys.

An example of the shape memory alloy in Nitinol. This is made of nickel, titanium, a small amount of iron and a small amount of nitrogen. In metallurgical terms, this can be expressed as:

Ni-(40~52)Ti-(0~0.1)Fe-(0~0.1)N

Where the numbers in parentheses indicate ranges of weight percentage of each following element. Other examples of shape memory alloys are:

Cu-(13~16)Al-(3~6)Ni,

Au-(4018 55)Cd,

Cu-(18~25)Zn-(5~7)Al,

Cu-(12~16)Sn and other alloys such as Ag-Cd, Ag-Zn, Cu-Al, Cu-Zn, Fe-Bn, Fe-Pt, In-Tl, Nb-Ti, Ni-Al, etc.

An object of this invention is to make toys and other objects with shape memory alloys so that they regain their prefixed shapes upon a heat supply by a user after they are deformed for any purpose.

Another object of the invention is to make the toys repeatedly usable without permanently damaging them after each use.

Another object of the invention is to cover the alloys with soft plastics to improve the appearance of the toys.

Other objects of the invention will become apparent to those skilled in the art in the light of the following description.

Figure 1:
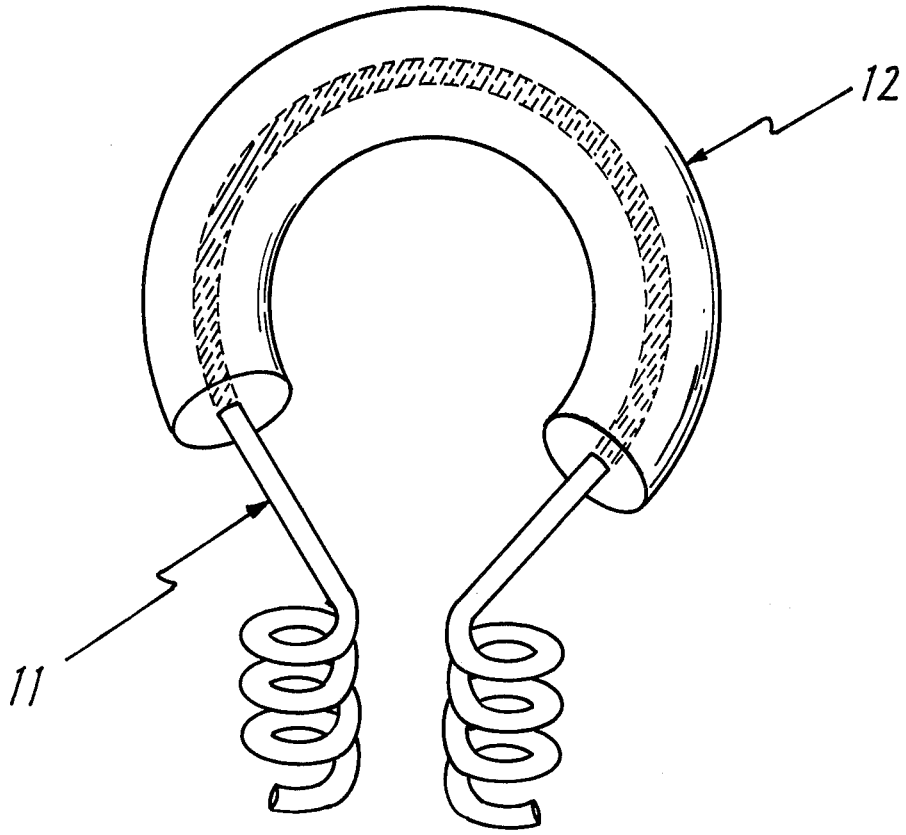

In accomplishing these objects of the invention, I have provided the improved details of construction, the preferred forms of which are illustrated in the accompanying drawings wherein FIG. 1 is a perspective view illustrating the construction of a shape memory alloy toy having spring shaped ends and a plastic wrapped around it.

Figure 2A:
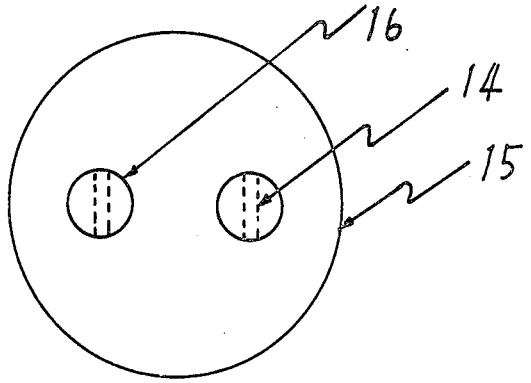
Figure 2B:
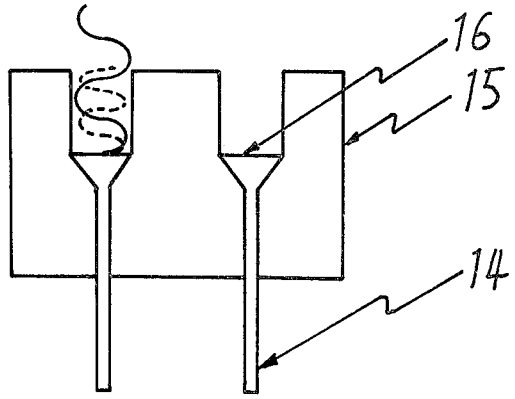

FIG. 2*a* is a top view of an adaptor and FIG. 2*b* is a side view of the adaptor illustrating different positions of spring shaped ends of the shape memory alloy element before they are heated (dotted lines, deformed) and after they are heated (solid lines, showing their original shape).

Figure 3:
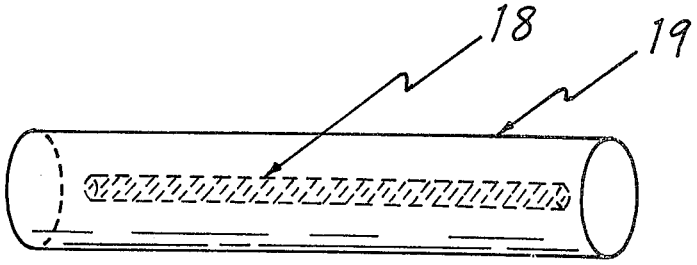

FIG. 3 is a perspective view illustrating an alternative construction of a shape memory alloy toy having the shape memory alloy completely surrounded by another material.

In the accompanying drawings, 11 in FIG. 1 is a wire of a shape memory alloy and 12 is a pliable plastic, for example, nylon, polyethylene, polypropylene, polytefrafluors ethyline, polyvinylchloride or vinylchloride acetate. The plastic can be of any shape, can be toys or any other three dimensional images for decoration, play and other purposes.

In the room temperature (below the transition temperature of the alloy), the above wire is mechanically weak and it can be deformed under force as the plastic more or less conforms to the shape of the wire. The relative strength of the wire, and the plastic can be controlled by varying their thicknesses. The object shown in FIG. 1 regains its original shape after the deformation when the two ends of the wire 11 are connected to electricity completing a circuit. This action produces heat in the wire raising the temperature. When the temperature of the wire is raised above the transition temperature, the wire springs back into its original shape.

The above procedure can be facilitated by using an adaptor shown in FIG. 2*a* and FIG. 2*b* . FIG. 2*a* is a top view of the adaptor and FIG. 2*b* is the side view. In the Figures, 14 is a adaptor body made of a hard electricity - and heat - insulating material, possibly a plastic, and 15 are two prongs to be plugged into an electrical outlet. The top surfaces, 16, of the prongs, 15, are flat such that two spring ends of the wire, 11, can be pressed upon them. If the springs are slightly squeezed before being pressed upon the surfaces of the prongs, when they also get heated they try to get back to their own original shape. This makes them jump out off the prong surfaces so that the electrical circuit is broken and heat is no longer supplied to the wire.

FIG. 3 shows another possible construction of a shape memory alloy toy having the shape memory alloy element, 18, completely surrounded by another material, 19. In this case, the shape regaining action can be achieved by heating the shape memory alloy element through the material which surrounds the alloy element. One such way is to immerse the toy in a hot water bath.

The object can also regain its original shape, after deformation, by being submerged in a surrounding whose temperature is higher than the transition temperature of the wire but lower than the melting temperature of the plastic. Hot water bath is one example. Heat is transferred from the hot surroundings to the wire to increase its temperature beyond the transition temperature.

It is to be understood that the toy might vary in its details of design, construction and material without departing from the spirit of the invention. For instance, instead of a soft plastic, cloth can be used in its place.

I claim:

1. toy having a form which may be repeatedly changed, comprising:

a shape memory alloy element, for example, Nitinol, comprising nickel and titanium, having a transition temperature at which metallic phases of the alloy change and above which the said shape memory alloy element is mechanically stronger than the said shape memory alloy element of temperature below the said transition temperature;

a pliable plastic element wrapped around the said memory element;

said shape memory element having a fixed shape, any shape, obtained through cold or hot shaping, for example, annealing;

said shape memory alloy being easily deformable at a temperature which is lower than the said transition temperature, and after a deformation, regaining its said fixed shape by obtaining an external source of heat so as to raise its temperature beyond the said transition temperature.

2. A method of automatically detaching, from an electrical circuit, a shape memory alloy element having a transition temperature at which metallic phases of the alloy change (when the said shape memory alloy element, which was deformed while mechanically weak at a temperature below the said transition temperature, regains its original shape, which was fixed by cold or hot shaping, by obtaining heat and thereby its temperature beyond the said transition temperature), and having a continuous shape like a wire or a ribbon such that when two ends of the said shape memory element are connected to a high voltage end (one) and to a low voltage end (the other) of an electrical open circuit, electric current flows through the entire body of the said shape memory alloy element, by fixing the shape of the said two ends into spring shapes, and by squeezing and pushing the said spring-shaped ends against electricity terminals, thereby creating a spring action in the said two ends when they are heated by electrical resistive heating to jump out of connection to the electricity terminals.

3. An electrical connector comprising:

two long metal conducting elements, which are called prongs, each prong having one end long and thin such that this end can be plugged into normal household electrical outlets and having the other end flat;

a thermal and electrical insulator element which houses the said metal elements exposing both ends of the said metal elements; spring shaped elements removably contacting said flat sides, said spring elements having a spring axis perpendicular to said flat ends;

said flat ends of the said prongs acting as electricity terminals when the long and thin ends of the said prongs are plugged into electrical outlets such that spring shaped elements of a long shape memory alloy element, which is deformed while mechanically weak at a temperature below its transition temperature at which metallic phases of the alloy change, are squeezed and pushed against the said flat side of the said prongs in order to establish a closed circuit thereby heating the said shape memory alloy element through electrical resistive heating, causing the said spring shaped elements to jump out of the contact with the said flat sides of the said prongs as the said spring shaped elements regain flat sides of the said prongs as the said spring shaped elements regain their original shapes.

* * * * *